US010869506B2

(12) United States Patent
Chen

(10) Patent No.: US 10,869,506 B2
(45) Date of Patent: Dec. 22, 2020

(54) CONDUCTIVE CONTACT STRUCTURE, ELECTRODE ASSEMBLY, POWER SUPPLY ASSEMBLY AND ELECTRONIC CIGARETTE HAVING SAME

(71) Applicant: SHENZHEN IVPS TECHNOLOGY CO., LTD., Shenzhen, Guangdong Province (CN)

(72) Inventor: Wen Chen, Shenzhen (CN)

(73) Assignee: SHENZHEN IVPS TECHNOLOGY CO., LTD., Guangdong (CN)

( * ) Notice: Subject to any disclaimer, the term of this patent is extended or adjusted under 35 U.S.C. 154(b) by 192 days.

(21) Appl. No.: 15/881,768

(22) Filed: Jan. 27, 2018

(65) Prior Publication Data

US 2018/0206555 A1 Jul. 26, 2018

(30) Foreign Application Priority Data

Nov. 30, 2016 (CN) ..... 2016 2 1311448 U
Jan. 19, 2018 (CN) ..... 2018 2 0100564 U

(51) Int. Cl.
*A24F 13/00* (2006.01)
*A24F 17/00* (2006.01)
(Continued)

(52) U.S. Cl.
CPC ..... *A24F 47/008* (2013.01); *H01R 13/2421* (2013.01); *H01R 13/521* (2013.01);
(Continued)

(58) Field of Classification Search
CPC ..... A24F 47/00; A24F 47/008; A24F 40/40; A24F 40/90
(Continued)

(56) References Cited

U.S. PATENT DOCUMENTS 6,155,869 A * 12/2000 Monsef ..... G01C 15/02 439/500
2004/0253867 A1* 12/2004 Matsumoto ..... H01H 13/86 439/500
(Continued)

FOREIGN PATENT DOCUMENTS

CN 203168034 U 9/2013
CN 203492791 U 3/2014
(Continued)

*Primary Examiner* — Abdullah A Riyami
*Assistant Examiner* — Thang H Nguyen
(74) *Attorney, Agent, or Firm* — IP-PAL Patent US; Klaus Michael Schmid

(57) ABSTRACT

The present disclosure provides a conductive contact structure for a power supply assembly. The power supply assembly includes a cover body, and a main body inbuilt with a master control board. The cover body and the main body define an installation space therebetween. The conductive contact structure includes a negative electrode assembly, a sealing element, an insulating assembly and a positive electrode assembly that are disposed in sequence in the installation space. The negative electrode assembly is configured for passing through the cover body to abut against the sealing element and defines a through hole. The insulating assembly has one end configured for covering the positive electrode assembly on the main body and has the other end abutting against the sealing element. The positive electrode assembly is configured for partially passing through the insulating assembly and the sealing element in sequence to be accommodated in the through hole.

8 Claims, 9 Drawing Sheets

(51) Int. Cl.

| | |
|---|---|
| ***A24F 25/00*** | (2006.01) |
| ***A24F 47/00*** | (2020.01) |
| ***H01R 13/52*** | (2006.01) |
| ***H01R 13/24*** | (2006.01) |
| ***H05B 3/44*** | (2006.01) |
| ***H05B 3/04*** | (2006.01) |
| ***H05B 3/03*** | (2006.01) |

(52) U.S. Cl.
CPC ..... *H01R 13/5219* (2013.01); *H05B 3/03* (2013.01); *H05B 3/04* (2013.01); *H05B 3/44* (2013.01)

(58) Field of Classification Search
USPC ..... 131/329; 439/500

See application file for complete search history.

(56) References Cited

U.S. PATENT DOCUMENTS

| | | | | |
|---|---|---|---|---|
| 2015/0101626 | A1* | 4/2015 | Li | A24F 47/008 131/329 |
| 2019/0000146 | A1* | 1/2019 | Lin | H01M 2/1055 |
| 2019/0223498 | A1* | 7/2019 | Ouyang | H01M 2/1022 |
| 2019/0223503 | A1* | 7/2019 | Liu | A24F 7/00 |

FOREIGN PATENT DOCUMENTS

| | | | | |
|---|---|---|---|---|
| CN | 206612212 | * | 11/2016 | A24F 47/00 |
| CN | 106579556 | A | 4/2017 | |
| CN | 206284397 | U | 6/2017 | |
| CN | 206612212 | U | 11/2017 | |
| CN | 206714076 | U | 12/2017 | |
| EP | 2862459 | A1 | 4/2015 | |
| EP | 3398458 | * | 12/2015 | A24F 47/008 |
| EP | 3398458 | A1 | 11/2018 | |
| WO | 2013181796 | A1 | 12/2013 | |
| WO | 2014201612 | A1 | 12/2014 | |
| WO | 2017075753 | A1 | 5/2017 | |

* cited by examiner

CONDUCTIVE CONTACT STRUCTURE, ELECTRODE ASSEMBLY, POWER SUPPLY ASSEMBLY AND ELECTRONIC CIGARETTE HAVING SAME

CROSS REFERENCE TO RELATED APPLICATIONS

The present application claims priority to Chinese Patent Application CN 201621311448.6 filed on Nov. 30, 2016 and to Chinese Patent Application CN 201820100564.6 filed on Jan. 19, 2018.

TECHNICAL FIELD

The present disclosure relates to a conductive contact structure, an electrode assembly, a power supply assembly, and an electronic cigarette having same.

BACKGROUND

Electronic cigarette, also called simulating cigarette, is mainly used for quitting smoking and substituting conventional cigarettes. The electronic cigarette has the same appearance as conventional cigarettes and the similar flavor to conventional cigarettes, even has more flavors than conventional cigarettes. The electronic cigarette also can create aerosols, flavors and a feeling of smoking, like conventional cigarettes. The electronic cigarette has no harmful ingredients such as tar and particulate matter existing in conventional cigarettes; therefore, conventional cigarettes are gradually substituted by electronic cigarettes on the market. Current electronic cigarettes supply power to a heating unit in an atomizer through a power supply assembly, so that the heating unit heats a tobacco liquid to generate an aerosol under the driving of the power supply assembly and the user gets a feel of smoking.

Conventional electronic cigarettes have a conductive contact structure configured for connecting the atomizer and the power supply assembly. However, the conductive contact structure is complex and has many parts. Gaps are easy to generate between each part. In the process of a user using the electronic cigarette, the user generally installs the atomizer on the power supply assembly all the time. If a leakage-proof structure in the atomizer is weak, the tobacco liquid is easy to leak into the power supply assembly from the conductive contact structure, thereby causing damage of electrical elements in the power supply assembly.

At present, the contact electrode of a conventional electronic cigarette for connecting the atomizer and the battery is complicated in structure and has a large number of parts. Since the space inside the product is small, during welding, the insulating member between the positive electrode and the negative electrode may be easily damaged, and short circuit occurs. This affects product quality, and has latent safety risks.

SUMMARY

The present disclosure mainly aims to provide a conductive contact structure, so as to enhance the sealing performance of the conductive contact structure and avoid the condition that the tobacco liquid leaks into the power supply assembly from the conductive contact structure.

In order to achieve the above aim, the present disclosure provides a conductive contact structure, which is applied to a power supply assembly. The power supply assembly includes a cover body, and a main body inbuilt with a master control board. The cover body and the main body define an installation space therebetween. The conductive contact structure includes a negative electrode assembly, a sealing element, an insulating assembly and a positive electrode assembly that are disposed in sequence in the installation space. The negative electrode assembly is configured for passing through the cover body to abut against the sealing element and defines a through hole configured for installing an external load. The insulating assembly has one end configured for covering the positive electrode assembly on the main body and has the other end abutting against the sealing element. The positive electrode assembly is configured for partially passing through the insulating assembly and the sealing element in sequence to be accommodated in the through hole. The master control board is configured to be in electric connection with the positive electrode assembly and the negative electrode assembly.

Optionally, one of the insulating assembly and the sealing element is provided with at least one locating block while the other one defines locating grooves, and one of the locating blocks is inserted into one of the locating grooves so as to fix the sealing element to the insulating assembly.

Optionally, the sealing element includes a big-diameter portion and at least one small-diameter portion located at the periphery of the big-diameter portion, the big-diameter portion is configured for blocking the through hole and defines a relief hole allowing the positive electrode assembly to pass through, and the small-diameter portion is opened/provided with the locating groove/locating block.

Optionally, the relief hole is defined directing facing a center position of the through hole, and the relief hole has a diameter smaller than that of the through hole.

Optionally, the insulating assembly includes a limiting plate and an insulating plate that fit a lateral edge structure of the positive electrode assembly, the limiting plate is configured to be installed on the main body and to enclose an accommodating groove, the insulating plate has one end configured for covering the accommodating groove and has the other end provided with at least one locating block, and the positive electrode assembly has one end elastically installed in the accommodating groove and abutting against the insulating plate and has the other end passing through the insulating plate and the relief hole to be accommodated in the through hole.

Optionally, the insulating assembly includes an insulating ring, and the insulating ring is configured to be sleeved on the outer circumference of the positive electrode assembly located inside the through hole and to abut against an inner wall of the through hole.

Optionally, the negative electrode assembly includes a connector and a conducting ring, the connector has one end embedded into the cover body and the other end accommodated in the installation space, the through hole is defined in the connector, the conducting ring is configured to be sleeved on the connector and abut against the sealing element, the connector is limited in the installation space, and the conducting ring is configured for electrically conducting the connector to the master control board.

Optionally, the positive electrode assembly includes a conducting column and a conducting elastic sheet, the conducting column has one end passing through the insulating assembly and the sealing element to be accommodated in the through hole and has the other end fixedly connected to the conducting elastic sheet, and the conducting elastic sheet is configured to be fixedly installed on the master control board and to be electrically conducted to the conducting column.

The present disclosure further provides a power supply assembly. The power supply assembly includes a cover body, a main body inbuilt with a master control board, and a conductive contact structure. The cover body and the main body define an installation space therebetween. The conductive contact structure includes a negative electrode assembly, a sealing element, an insulating assembly and a positive electrode assembly that are disposed in sequence in the installation space. The negative electrode assembly is configured for passing through the cover body to abut against the sealing element and defines a through hole configured for installing an external load. The insulating assembly has one end configured for covering the positive electrode assembly on the main body and has the other end abutting against the sealing element. The positive electrode assembly is configured for partially passing through the insulating assembly and the sealing element in sequence to be accommodated in the through hole. The master control board is configured to be in electric connection with the positive electrode assembly and the negative electrode assembly.

The present disclosure further provides an electronic cigarette. The electronic cigarette includes an atomizer and a power supply assembly. The power supply assembly includes a cover body, a main body inbuilt with a master control board, and a conductive contact structure. The cover body and the main body define an installation space therebetween. The conductive contact structure includes a negative electrode assembly, a sealing element, an insulating assembly and a positive electrode assembly that are disposed in sequence in the installation space. The negative electrode assembly is configured for passing through the cover body to abut against the sealing element and defines a through hole configured for installing the atomizer. The insulating assembly has one end configured for covering the positive electrode assembly on the main body and has the other end abutting against the sealing element. The positive electrode assembly is configured for partially passing through the insulating assembly and the sealing element in sequence to be accommodated in the through hole. The master control board is configured to be in electric connection with the positive electrode assembly and the negative electrode assembly.

According to the conductive contact structure in the technical scheme of the present disclosure, the negative electrode assembly passes through the cover body to abut against the sealing element, so that the tobacco liquid can be prevented leaking from the outer circumference of the negative electrode assembly and from the gap between the through hole and the insulating assembly; meanwhile, the positive electrode assembly partially passes through the insulating assembly and the sealing element in sequence to be accommodated in the through hole, that is, the sealing element is sleeved on the positive electrode assembly, which further prevents the tobacco liquid leaking from the gap between the positive electrode assembly and the insulating assembly. The sealing performance of the conductive contact structure is effectively enhanced. The condition that the tobacco liquid leaks into the power supply assembly from the conductive contact structure is avoided.

The present disclosure is intended to provide an electrode assembly and an electronic cigarette in order to improve yield rate and security of the electrode assembly.

To achieve the above objective, the present disclosure provides an electrode assembly. The electronic assembly includes a support and a top cap that are respectively arranged two opposite sides, a positive electrode, an insulating member and a negative electrode that are arranged between the support and the top cap; wherein the positive electrode comprises a bottom plate, a conducting pillar arranged on the bottom plate and facing towards the top cap, and a welding tab extending from a side of the bottom plate towards the support, and the insulating member comprises an insulating plate arranged between the bottom plate and the negative electrode and a boss arranged on the insulating plate and facing towards the top cap, the boss being provided with a via hole for the conducting pillar to pass through, and the negative electrode being sleeved onto the boss.

Preferably, the electrode assembly further includes a connecting joint embedded into the top cap; wherein the connecting joint is provided with a through hole for accommodating the boss, and the negative electrode is sleeved onto a part of an outer side wall of the connecting joint forming the through hole.

Preferably, the electrode assembly further includes an elastic member arranged between the support and the positive electrode.

Preferably, the elastic member is a spring.

Preferably, the spring is a conical spring, wherein a projection of the conical spring on a side of the positive electrode towards the positive electrode is greater than a projection thereof on the side of the positive electrode towards the support.

Preferably, a spring fixing column is arranged on a side of the support facing towards the spring.

Preferably, a plurality of spring limiting points are arranged on a side of the bottom plate of the positive electrode facing towards the spring, wherein the plurality of spring limiting points collaboratively act to fix the spring.

Preferably, an inner side wall forming the through hole is provided with female threads for connecting a contact electrode of an atomizer.

Preferably, the positive electrode, the negative electrode and the connecting joint are both made of copper.

The present disclosure further provides an electronic cigarette. The electronic cigarette includes the electronic assembly as described above.

In the technical solution according to the present disclosure, the support and the top cap are respectively arranged on two ends of the entire electrode assembly, the support is in contact with a battery cabinet of the electronic cigarette, the positive electrode is arranged above the support, the conducting pillar of the positive electrode is of a cylindrical shape and passes through the through hole of the boss of the insulating member, and forms communication of the positive electrode with the contact electrode of the atomizer, and the negative electrode is of an annular shape and sleeved onto the outer side of the boss, and forms communication of the negative electrode with the contact electrode of the atomizer. According to the present disclosure, the structural length of the electrode assembly is reduced to adapt to the narrow space inside the electronic cigarette product, and by virtue of the welding tab extending from the side of the bottom plate towards the support on the positive electrode, the positive electrode may weld the conducting wire to connect to the PCB control board via the welding tab on the side. This addresses the problem of short circuit caused by damaging the insulating member due to small operation space during assembling, and improves yield rate and security of the electronic assembly.

BRIEF DESCRIPTION OF THE DRAWINGS

For a better understanding of the embodiments of the present disclosure or the technical scheme in the prior art, accompanying drawings needed in the description of the embodiments or the prior art are simply illustrated below. Obviously, the accompanying drawings described below are some embodiments of the present disclosure. For the ordinary skill in the field, other accompanying drawings may be obtained according to the structure shown in these accompanying drawings without creative work.

Description of reference numbers

Figure 1:
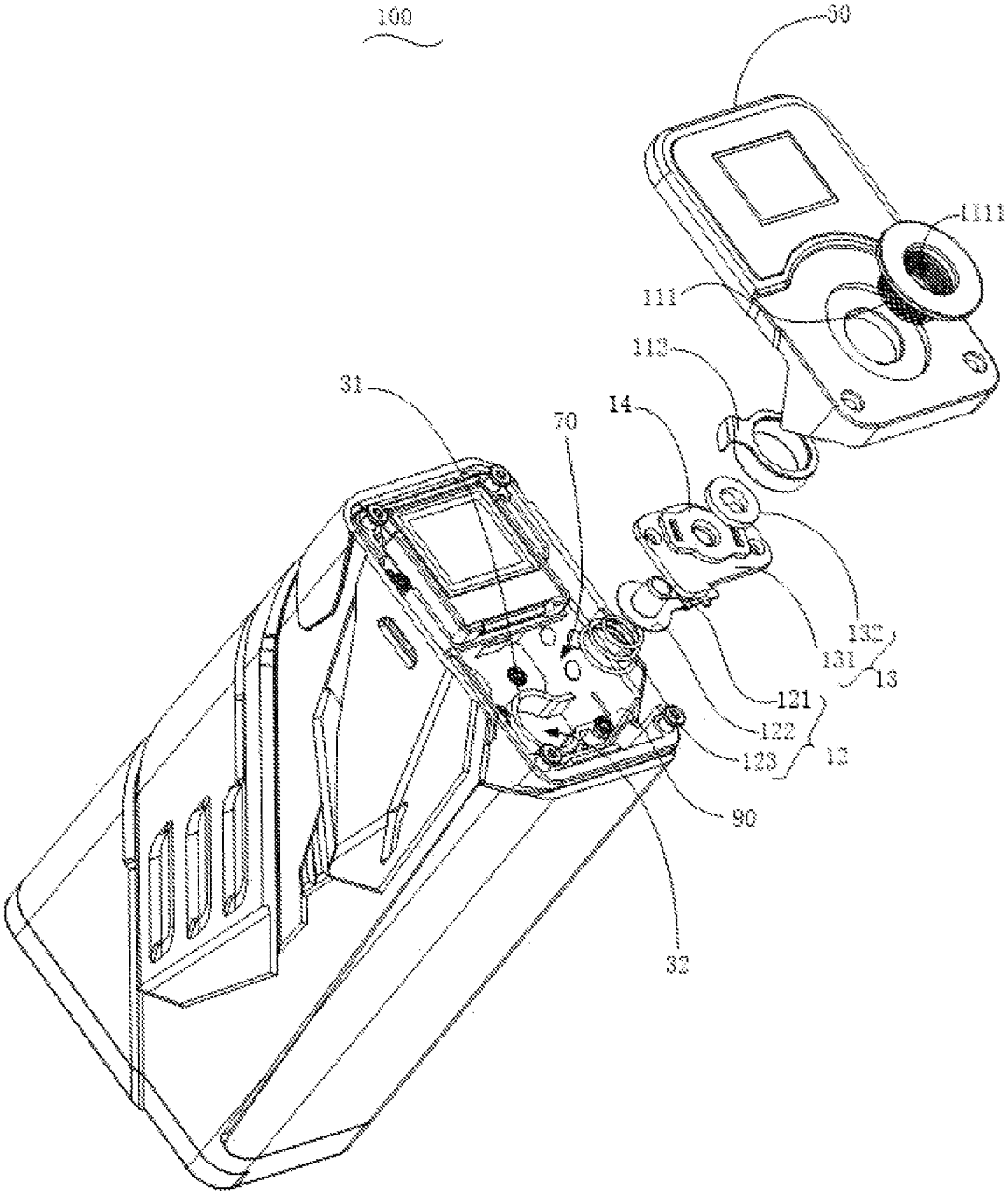
FIG. 1 is an exploded view of a conductive contact structure installed to a connection structure of a power supply assembly according to the present disclosure.

| Reference number | Name of Part | Reference number | Name of Part |
|---|---|---|---|
| 100 | Power supply assembly | 131 | Insulating plate |
| 10 | conductive contact structure | 1311 | Locating block |
| 11 | Negative electrode assembly | 132 | Insulating ring |
| 111 | Connector | 14 | Sealing element |
| 1111 | Through hole | 141 | Big-diameter portion |
| 112 | Conducting ring | 1411 | Relief hole |
| 1121 | Wiring pin | 142 | Small-diameter portion |
| 12 | Positive electrode assembly | 1421 | Locating groove |
| 121 | Conducting column | 30 | Main body |
| 1211 | Accommodating chamber | 31 | Limiting plate |
| 122 | Conducting elastic sheet | 32 | Accommodating groove |
| 1221 | Bended portion | 50 | Cover body |
| 123 | Elastic element | 70 | Installation space |
| 13 | Insulating assembly | 90 | Master control board |
| 10a | support | 30a | insulating member |
| 11a | spring fixing column | 31a | insulating plate |
| 20 | positive electrode | 32a | boss |
| 21 | bottom plate | 40 | negative electrode |
| 22 | conducting pillar | 50a | connecting joint |

-continued

Description of reference numbers

| Reference number | Name of Part | Reference number | Name of Part |
|---|---|---|---|
| 23 | welding tab | 60 | top cap |
| 24 | spring limiting point | 70a | elastic member |

The implementation of aims, the function features and the advantages of the present disclosure are described below in further detail in conjunction with embodiments with reference to the drawings.

DETAILED DESCRIPTION

A clear and complete description as below is provided for the technical scheme in the embodiments of the present disclosure in conjunction with the drawings in the embodiments of the present disclosure. Obviously, the embodiments described hereinafter are simply part embodiments of the present disclosure, but all the embodiments. All other embodiments obtained by the ordinary skill in the art based on the embodiments in the present disclosure without creative work are intended to be included in the scope of protection of the present disclosure.

It should be noted that all directional indications (such as top, bottom, left, right, front, behind . . . ) in the embodiments of the present disclosure are merely to illustrate a relative position relation, a relative motion condition, etc. between each part in a certain state (for example, the state shown in the drawings). If the state changes, the directional indication changes accordingly.

In addition, terms "first", "second", etc. appearing in the present disclosure are merely for the purpose of description, but cannot be understood as the indication or implication of relative importance or as the implicit indication of the number of the designated technical features; therefore, features defined by "first" and "second" may specifically or implicitly include at least one such feature. In addition, technical schemes of each embodiment of the present disclosure may be combined mutually; however, this must be carried out on the basis that the ordinary skill in this field can implement the combination. When the combination of technical schemes has a conflict or cannot be implemented, it should be considered that such combination of technical schemes does not exist and is not in the scope of protection claimed by the present disclosure.

In the present disclosure, unless otherwise specifically stated and defined, terms "connected", "fixed", etc. should be interpreted expansively. For example, "fixed" may be fixed connection, also may be detachable connection, or integration; may be mechanical connection, also may be electrical connection; may be direct connection, also may be indirect connection through an intermediate, and may be internal communication between two elements or interaction of two elements, unless otherwise specifically defined. The ordinary skill in this field can understand the specific implication of the above terms in the present disclosure according to specific conditions.

The present disclosure provides a conductive contact structure 10, which is applied to a power supply assembly 100. The power supply assembly 100 includes a cover body 50, and a main body 30 inbuilt with a master control board 90. The cover body 50 and the main body 30 define an installation space 70 therebetween. The conductive contact structure 100 is configured for supplying power to an external load. In the embodiments of the present disclosure, taking the external load being an atomizer for example, the power supply assembly 100 and the atomizer form an electronic cigarette.

Referring to FIG. 1 to FIG. 7, in the embodiments of the present disclosure, the conductive contact structure 10 includes a negative electrode assembly 11, a sealing element 14, an insulating assembly 13 and a positive electrode assembly 12 that are disposed in sequence in the installation space 70. The negative electrode assembly 11 is configured for passing through the cover body 50 to abut against the sealing element 14 and defines a through hole 1111 configured for installing an external load. The insulating assembly 13 has one end configured for covering the positive electrode assembly 12 on the main body 30 and has the other end abutting against the sealing element 14. The positive electrode assembly 12 is configured for partially passing through the insulating assembly 13 and the sealing element 14 in sequence to be accommodated in the through hole 1111. The master control board 90 is configured to be in electric connection with the positive electrode assembly 12 and the negative electrode assembly 11.

According to the conductive contact structure 10 in the technical scheme of the present disclosure, the negative electrode assembly 11 passes through the cover body 50 to abut against the sealing element 14, so that the tobacco liquid can be prevented leaking from the outer circumference of the negative electrode assembly 11 and from the gap between the through hole 1111 and the insulating assembly 13; meanwhile, the positive electrode assembly 12 partially passes through the insulating assembly 13 and the sealing element 14 in sequence to be accommodated in the through hole 1111, that is, the sealing element 14 is sleeved on the positive electrode assembly 12, which further prevents the tobacco liquid leaking from the gap between the positive electrode assembly 12 and the insulating assembly 13. The sealing performance of the conductive contact structure 10 is effectively enhanced. The condition that the tobacco liquid leaks into the power supply assembly 100 from the conductive contact structure 10 is avoided.

Figure 4:
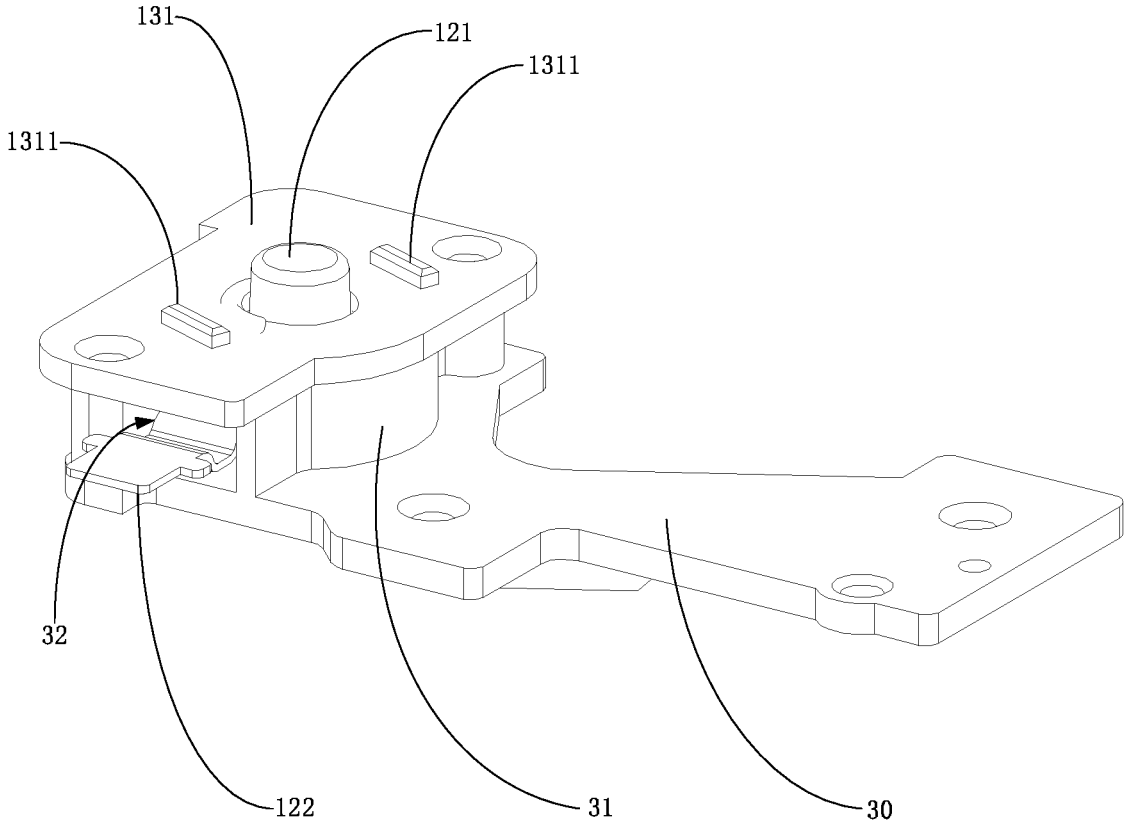
FIG. 4 is a perspective view of a positive electrode assembly installed to a connection structure of a main body according to the present disclosure.
Figure 5:
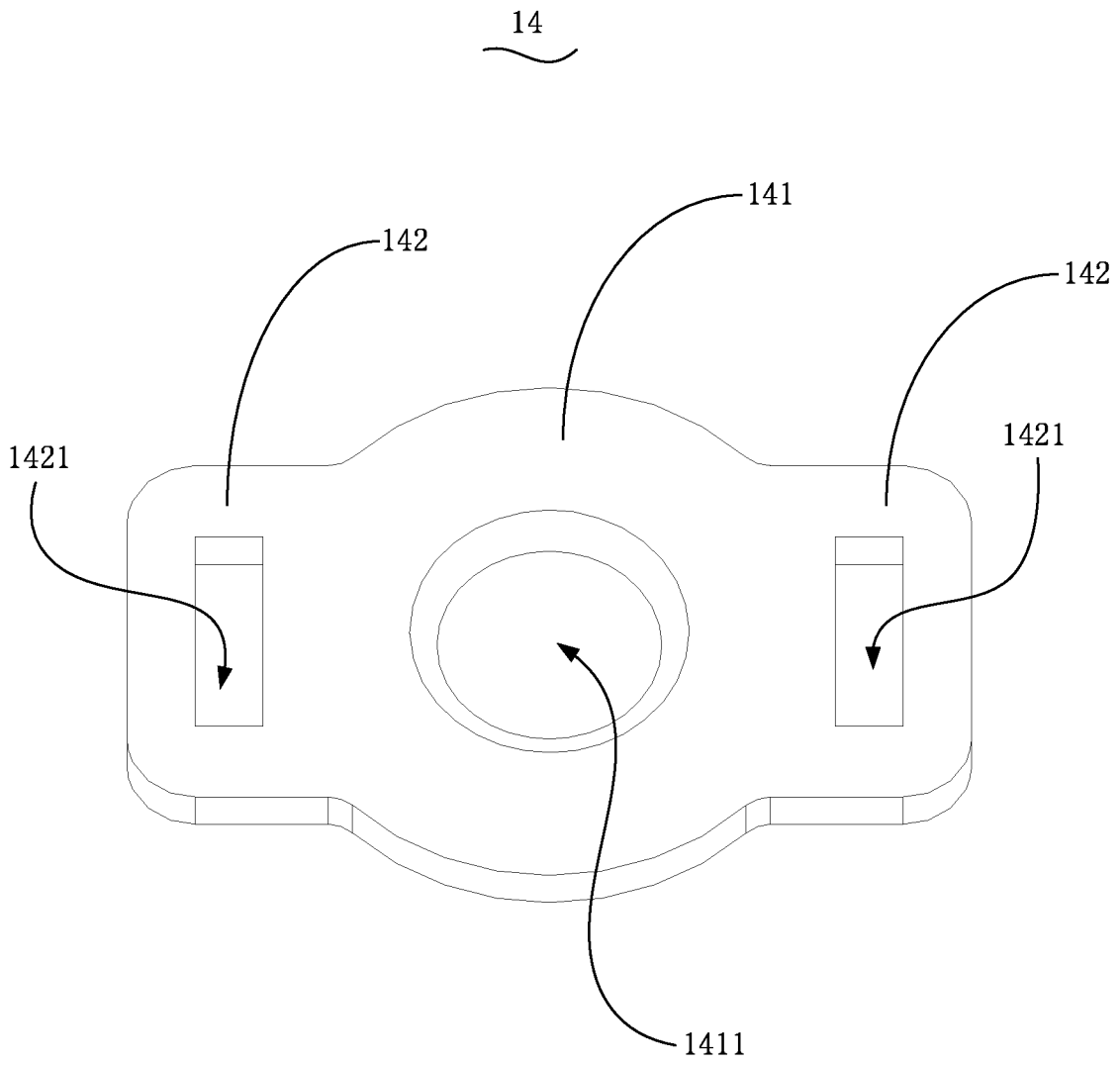
FIG. 5 is a perspective view of a connection structure of a sealing element according to the present disclosure.

Specifically, as shown in FIG. 1, FIG. 4 and FIG. 5, in the embodiments of the present disclosure, one of the insulating assembly 13 and the sealing element 14 is provided with at least one locating block 1311 while the other one defines locating grooves 1421. One of the locating blocks 1311 is inserted into one of the locating grooves 1421 so as to fix the sealing element 14 to the insulating assembly 13. Here, in the present embodiment, the sealing element 14 is made of elastic silicone materials. The insulating assembly 13 is provided with two locating blocks 1311 spaced apart on one end facing the cover body 50. The two locating blocks 1311 are configured to be disposed opposite to each other and spaced apart from each other at two sides of the positive electrode assembly 12. The sealing element 14 defines two locating grooves 1421 correspondingly. The sealing element 14 is fixed to the insulating assembly 13 by way of buckling the two locating elements in the two locating grooves 1421. The connection is firm and the sealing element 14 is convenient to install. Meanwhile, the condition that the sealing element 14 produces a displacement to result in a gap in the usage process is effectively avoided. Moreover, the elastic silicone material has certain elasticity and can be in tight fit with the insulating assembly 13 and the negative electrode assembly 11, thereby further avoiding the generation of gap.

It is understandable that, in the actual application, the number and the installation position of the locating block 1311 and the locating groove 1421 are not limited to the manner in the above embodiment that they are disposed opposite to each other and spaced apart from each other at two sides of the positive electrode assembly 12, and that users can select other numbers and installation positions according to specific sizes or shapes. The latter manner is also included in the scope of protection of the present disclosure.

Specifically, as shown in FIG. 5, in the embodiments of the present disclosure, the sealing element 14 includes a big-diameter portion 141 and at least one small-diameter portion 142 located at the periphery of the big-diameter portion 141. The big-diameter portion 141 is configured for blocking the through hole 1111 and defines a relief hole 1411 allowing the positive electrode assembly 12 to pass through. The small-diameter portion 142 is opened/provided with the locating groove 1421/locating block 1311. Here, in the present embodiment, the big-diameter portion 141 is provided with two small-diameter portions 142 at two sides thereof, and the big-diameter portion 141 blocks the through hole 1111 so as to effectively prevent the tobacco liquid leaking from the through hole 1111. The two small-diameter portions 142 are integrated with the big-diameter portion 141. The two locating grooves 1421 are sleeved on the two locating blocks 1311 provided on the insulating assembly 13. Such arrangement avoids that a whole piece of big-diameter sealing element 14 is needed to seal the parts. The material cost is effectively saved, and the installation space 70 is reduced.

Figure 2:
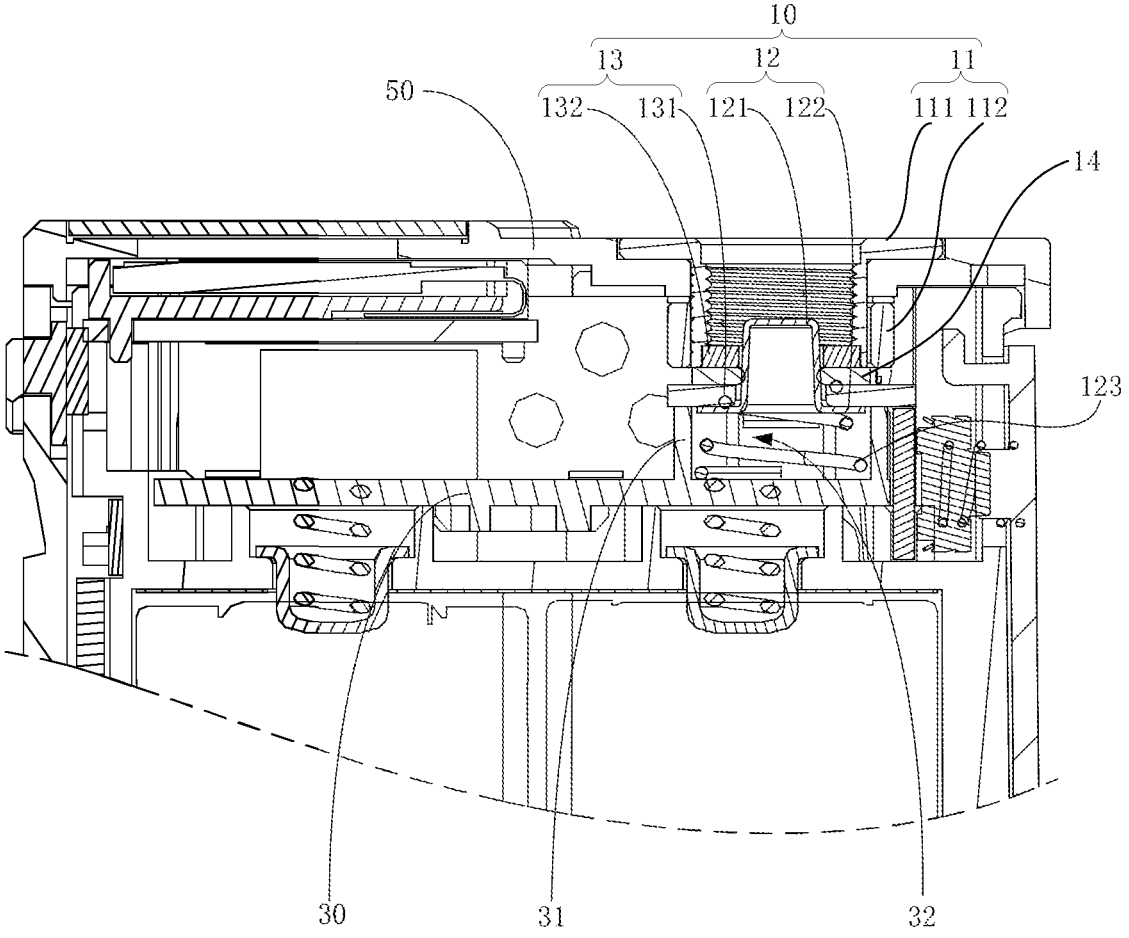
FIG. 2 is a cross-sectional view of a conductive contact structure installed to a connection structure of a power supply assembly according to the present disclosure.
Figure 3:
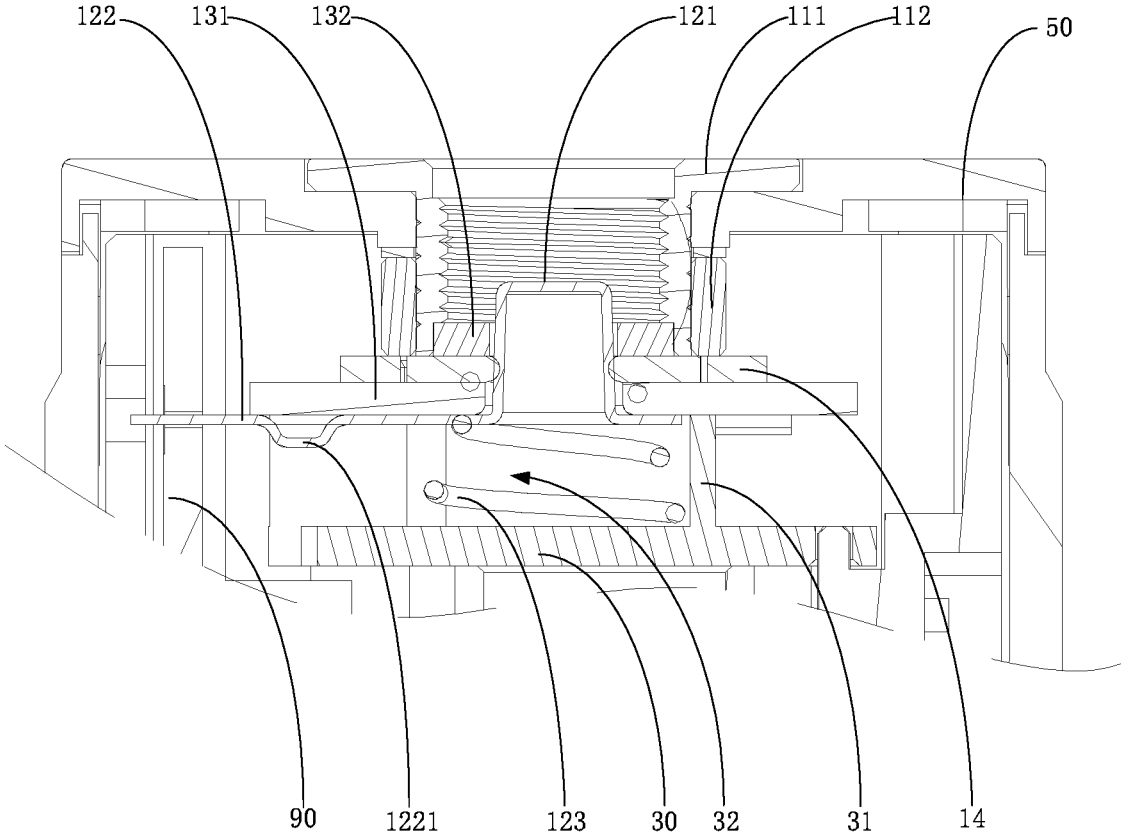
FIG. 3 is another cross-sectional view of a conductive contact structure installed to a connection structure of a power supply assembly according to the present disclosure.

Specifically, as shown in FIG. 2 and FIG. 3, the relief hole 1411 is defined directing facing a center position of the through hole 1111, and the relief hole 1411 has a diameter smaller than that of the through hole 1111. Here, in the present embodiment, the relief hole 1411 is defined directing facing the center position of the through hole 1111 and the relief hole 1411 has the diameter smaller than that of the through hole 1111. Such arrangement effectively ensures that the positive electrode assembly 12 is accommodated in the middle of the through hole 1111 and that the positive electrode assembly 12 keeps certain distance from the negative electrode assembly 11 all the time, and avoids the condition that the negative electrode assembly 11 and the positive electrode assembly 12 are in direct contact to cause a safety hazard of short circuit.

Specifically, as shown in FIG. 1 to FIG. 4, in the embodiments of the present disclosure, the insulating assembly 13 includes a limiting plate 31 and an insulating plate 131 that fit a lateral edge structure of the positive electrode assembly 12. The limiting plate 31 is configured to be installed on the main body 30 and to enclose an accommodating groove 32. The insulating plate 131 has one end configured for covering the accommodating groove 32 and has the other end provided with at least one locating block 1311. The positive electrode assembly 12 has one end elastically installed in the accommodating groove 32 and abutting against the insulating plate 131 and has the other end passing through the insulating plate 131 and the relief hole 1411 to be accommodated in the through hole 1111. Here, in the present embodiment, the limiting plate 31 encloses the accommodating groove 32, the positive electrode assembly 12 has one end elastically installed in the accommodating groove 32, and the insulating plate 131 covers the accommodating groove 32 and thus covers the positive electrode assembly 12 on the main body 30, so that the outer circumference of the positive electrode assembly 12 is packaged. Such arrangement can avoid the condition that an external conducting component (not shown in the drawings) contacts the positive electrode assembly 12 by error to cause a short circuit, and avoid the condition that the positive electrode assembly 12 shakes in the usage process to contact the negative electrode assembly 11 to cause a short circuit. The yield and safety of the power supply assembly 100 are effectively improved.

Figure 7:
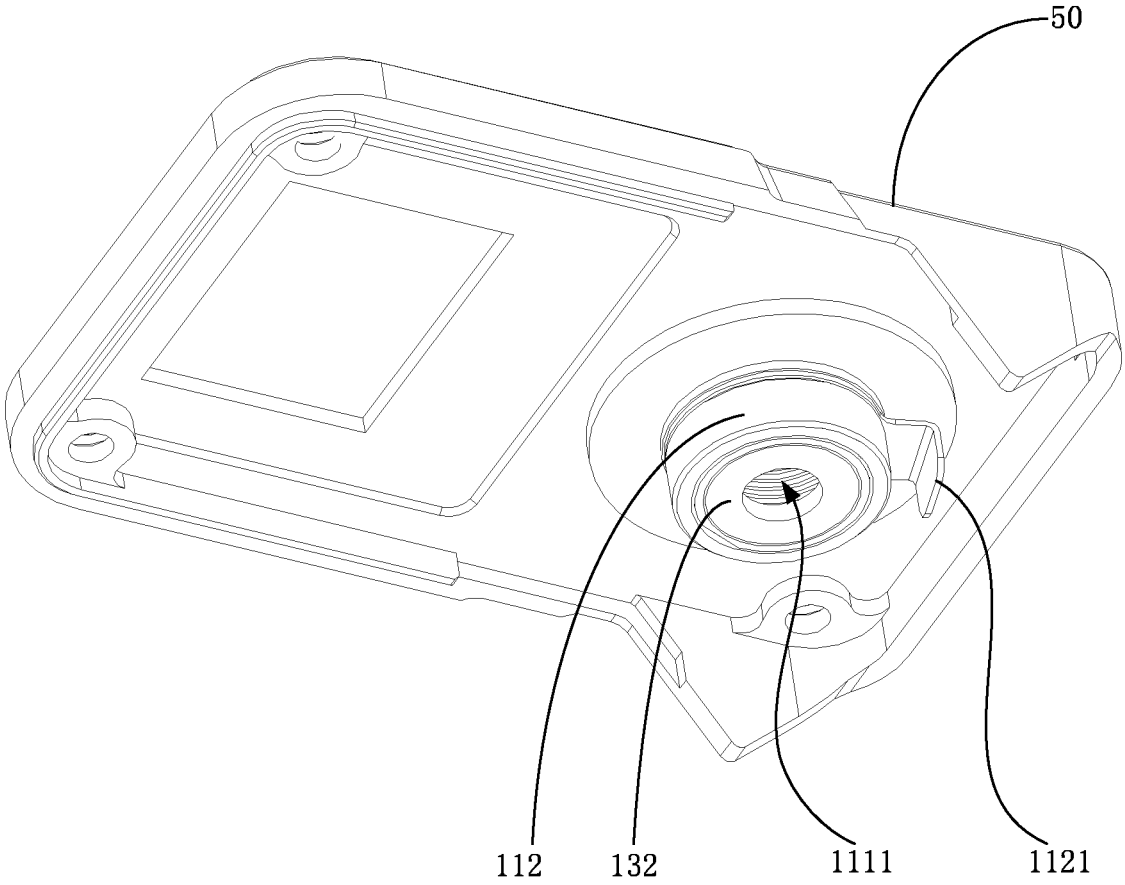
FIG. 7 is a perspective view of a negative electrode assembly installed to a connection structure of a cover body according to the present disclosure.

Specifically, as shown in FIG. 1 to FIG. 3 or in FIG. 7, in the embodiments of the present disclosure, the insulating assembly 13 includes an insulating ring 132. The insulating ring 132 is configured to be sleeved on the outer circumference of the positive electrode assembly 12 located inside the through hole 1111 and is configured to abut against an inner wall of the through hole 1111. Here, in the present embodiment, since the sealing element 14 is made of elastic silicone materials, the sealing element 14 has a soft texture. In order to avoid the condition that the positive electrode assembly 12 produces a displacement to directly contact the negative electrode assembly 11 to cause a short circuit in the long-time usage process, the insulating ring 132 is sleeved on partial outer circumference of the positive electrode assembly 12 located inside the through hole 1111, and an end portion of the negative electrode assembly 11 close to the positive electrode assembly 12 is expanded gradually or is provided with a limiting step to fit and abut against the insulating ring 132, so that the positive electrode assembly 12 and the negative electrode assembly 11 do not contact each other directly to cause a short circuit.

Specifically, as shown in FIG. 1 to FIG. 3 or in FIG. 7, in the embodiments of the present disclosure, the negative electrode assembly 11 includes a connector 111 and a conducting ring 112. The connector 111 has one end embedded into the cover body 50 and the other end accommodated in the installation space 70. The through hole 1111 is defined in the connector 111. The conducting ring 112 is configured to be sleeved on the connector 111 and abut against the sealing element 14. The connector 111 is limited in the installation space 70. The conducting ring 112 is configured for electrically conducting the connector 111 to the master control board 90. Here, in the present embodiment, the connector 111 has one end embedded into the cover body 50 and the other end accommodated in the installation space 70, and the conducting ring 112 is sleeved on the connector 111 by interference fit and abuts against the sealing element 14. Such arrangement effectively prevents the tobacco liquid leaking from the gap between the conducting ring 112 and the insulating assembly 13. Meanwhile, the connector 111 is fixed to the cover body 50, the connection is firm and no bolt is needed. Furthermore, the external load has a contact electrode fixedly and electrically connected to the connector 111 via the through hole 1111, thus, the conductive contact area is big, the stability of the electrical conduction is effectively ensured, and the generation of burning sensation is avoided when a big current passes.

Specifically, as shown in FIG. 7, in the embodiments of the present disclosure, the conducting ring 112 has an outer circumference extending out a wiring pin 1121, and the wiring pin 1121 defines a wiring hole. A lead wire is configured to passes through the wiring hole to be welded to the wiring pin 1121, thereby realizing electrical conduction. Such arrangement effectively facilitates the wiring and welding in a narrow space.

Specifically, as shown in FIG. 1 to FIG. 3, in the embodiments of the present disclosure, the through hole 1111 has the inner wall provided with connection threads (not marked in the drawings), the connection threads being configured to be in connection with a contact electrode of a load. Here, in the present embodiment, the negative electrode assembly is connected to the contact electrode of the load through the connection threads. The assembly and disassembly are convenient. Meanwhile, the connection is more stable and the structure is not easy to shake.

Specifically, as shown in FIG. 3 and FIG. 4, in the embodiments of the present disclosure, the positive electrode assembly 12 includes a conducting column 121 and a conducting elastic sheet 122. The conducting column 121 has one end passing through the insulating assembly 13 and the sealing element 14 to be accommodated in the through hole 1111 and has the other end fixedly connected to the conducting elastic sheet 122. The conducting elastic sheet 122 is configured to be fixedly installed on the master control board 90 and to be electrically conducted to the conducting column 121. Here, in the present embodiment, the conducting column 121 passes through the insulating plate 131 of the insulating assembly 13 and the sealing element 14 in sequence to be accommodated in the connection hole, so that the conducting column 121 keeps certain distance from the negative electrode assembly 11 all the time. When a load is installed on the power supply assembly, the load has an outer circumference negative contact electrode electrically connected to the connector 111 of the negative electrode assembly 11 and has a positive contact electrode abutting against the conducting column 121, so as to form an electric circuit. Meanwhile, the positive electrode assembly 12 is provided with the conducting elastic sheet 122, so that the positive electrode assembly 12 can be welded to the master control board 90 through the conducting elastic sheet 122 to realize electrical connection. Such arrangement avoids the connection through lead wires, further improves the product quality, and reduces the safety hazards caused by rosin joint. Meanwhile, wires are directly arranged on the master control board 90 and are electrically connected to the wiring pin 1121, so that the contact area is far greater than that of lead wire connection and the power supply assembly can bear a load with big current. Furthermore, the conducting elastic sheet 122 has certain elasticity. When a load is installed, the load presses against the conducting column 121, then, the conducting elastic sheet 122 applies certain elastic force to the conducting column 121 correspondingly, so that the conducting column 121 tightly abuts against the positive contact electrode of the load. The stability of current conduction is effectively enhanced.

Figure 6:
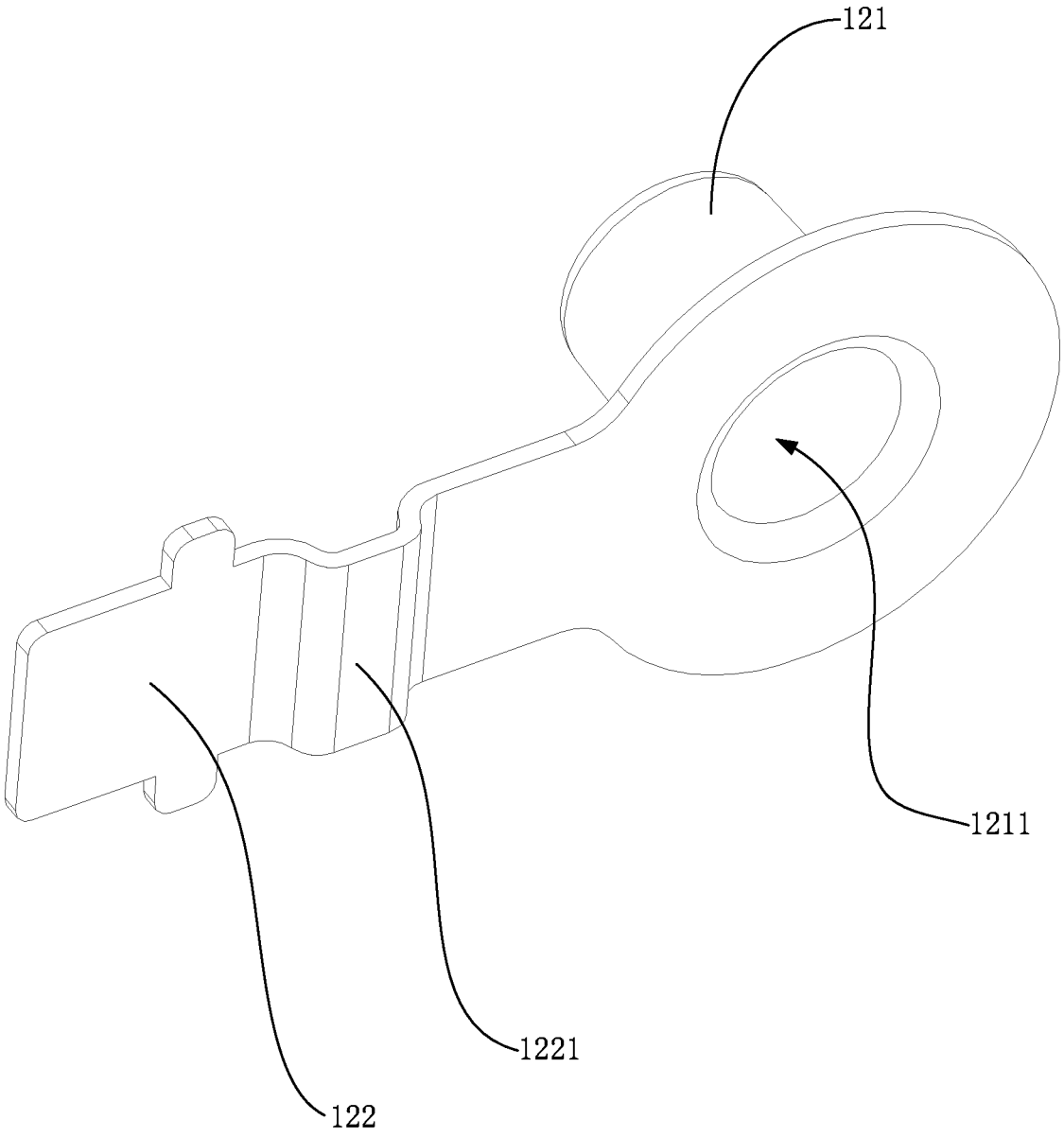
FIG. 6 is a perspective view of a connection structure of a positive electrode assembly according to the present disclosure.

Specifically, as shown in FIG. 3 or FIG. 6, in the actual application, the conducting elastic sheet 122 in the technical scheme of the present embodiment is provided with a bended portion 1221, to further enhance the elastic force of the conducting elastic sheet 122.

Specifically, as shown in FIG. 1 to FIG. 3, in the embodiments of the present disclosure, the positive electrode assembly 12 further includes an elastic element 123. The elastic element 123 has two ends abutting against the main body 30 and the conducting column 121 respectively. Here, the present embodiment arranges the elastic element 123 in the accommodating groove 32, thereby further enhancing the elastic force of the conducting column 121, so that the conducting column 121 can be in tight fit with the positive contact electrode of the load; meanwhile, the activity of the conducting column 121 can be increased, so that the conducting column 121 can dock various types of loads.

Specifically, as shown in FIG. 2, FIG. 3 or FIG. 6, in the embodiments of the present disclosure, the accommodating groove 32 has an inner wall provided with an elastic element fixing column (not shown in the drawings) corresponding to the positive electrode assembly 12; and/or, the conducting column 121 defines an accommodating chamber 1211 configured for accommodating the elastic element 123. Here, in the present embodiment, the arrangement of the elastic element fixing column and the action of sleeving the elastic element 123 on the elastic element fixing column can effectively prevent the elastic element 123 shaking and displacing in the usage process. Likewise, the arrangement of the accommodating chamber 1211 defined on the conducting column 121 for accommodating the elastic element 123 also can effectively prevent the elastic element 123 shaking and displacing in the usage process. The structure is more compact and the installation space 70 is reduced.

It is understandable that the elastic element 123 can employ a pressure spring or an elastic plastic in the actual application, and that the fixing manner of the elastic element 123 is not limited to the above manner of employing the elastic fixing column or defining the accommodating chamber 121. For example, the elastic element 123 also can employ a conical spring, and the big-diameter end of the conical spring is configured to abut against the limiting plate 31 to realize fixation. The manner in the example is also in the scope of protection of the present disclosure.

Referring to FIG. 1, the present disclosure further provides a power supply assembly 100. The power supply assembly 100 is applied to an electronic cigarette. The power supply assembly 100 includes a cover body 50, a main body 30 inbuilt with a master control board 90, and a conductive contact structure 10. The specific structure of the conductive contact structure 10 can be referred to the above embodiments. Since the power supply assembly 100 employs all technical schemes of all the above embodiments, the power supply assembly 100 at least has all beneficial effects brought by the technical schemes of the above embodiments. No further description is needed here.

The present disclosure further provides an electronic cigarette. The electronic cigarette includes an atomizer and a power supply assembly 100. The specific structure of the power supply assembly 100 can be referred to the above embodiments. Since the electronic cigarette employs all technical schemes of all the above embodiments, the electronic cigarette at least has all beneficial effects brought by the technical schemes of the above embodiments. No further description is needed here.

Figure 8:
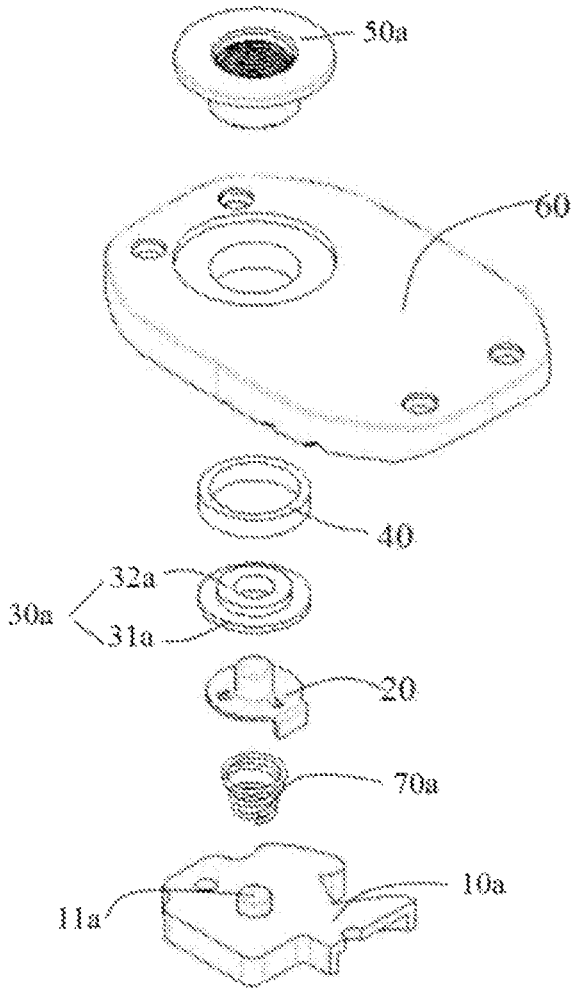
FIG. 8 is an exploded view of an electrode assembly according to the present disclosure.
Figure 9:
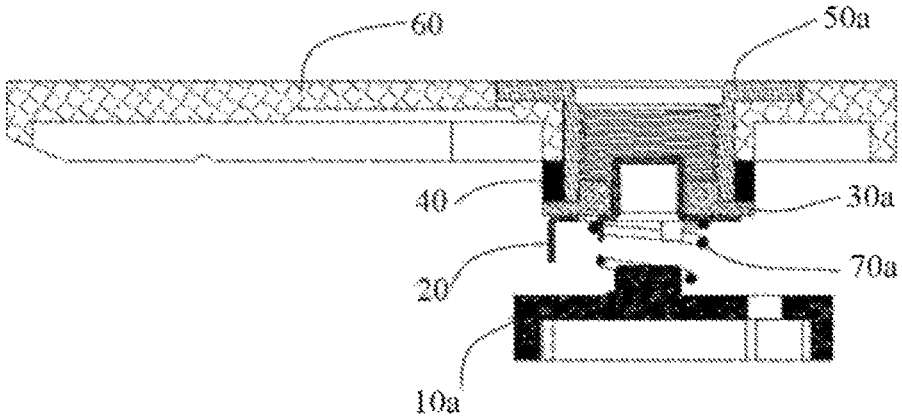
FIG. 9 is a sectional view of the electrode assembly according to the present disclosure.
Figure 10:
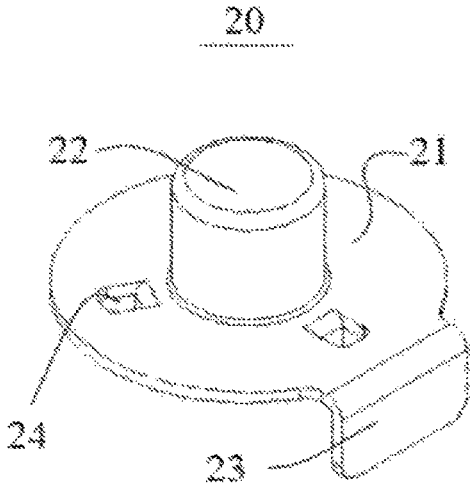
FIG. 10 is a structural view of a positive electrode according to the present disclosure.

Referring to FIG. 8 to FIG. 9, the present disclosure provides an electrode assembly. The electronic assembly includes a support 10*a* and a top cap 60 that are respectively arranged two opposite sides, a positive electrode 20, an insulating member 30*a* and a negative electrode 40 that are arranged between the support 10*a* and the top cap 60; wherein the positive electrode 20 includes a bottom plate 21, a conducting pillar 22 arranged on the bottom plate 21 and facing towards the top cap 60, and a welding tab 23 extending from a side of the bottom plate 21 towards the support 10*a*, and the insulating member 30*a* includes an insulating plate 31*a* arranged between the bottom plate 21 and the negative electrode 40 and a boss 32*a* arranged on the insulating plate 31*a* and facing towards the top cap 60, the boss being provided with a via hole (not shown in the drawings) for the conducting pillar 22 to pass through, and the negative electrode 40 being sleeved onto the boss 32*a*.

Specifically, the support 10*a* and the top cap 60 are respectively arranged on two ends of the entire electrode assembly, the support 10*a* is in contact with a battery cabinet (not shown in the drawings) of the electronic cigarette, the connecting joint 50*a* is configured to connect the contact electrode (not shown in the drawings) of the atomizer of the electronic cigarette, the positive electrode 20 is arranged above the support 10*a*, the conducting pillar 11*a* of the positive electrode 10*a* is of a cylindrical shape and passes through the through hole of the boss 32*a* of the insulating member 30*a*, and forms communication of the positive electrode with the contact electrode of the atomizer, and the negative electrode 40 is of an annular shape and sleeved onto the outer side of the boss 32*a*, and forms communication of the negative electrode with the contact electrode of the atomizer. According to the present disclosure, the structural length of the electrode assembly is reduced to adapt to the narrow space inside the electronic cigarette product, and by virtue of the welding tab 23 extending from the side of the bottom plate 21 towards the support 10*a* on the positive electrode 20, the positive electrode 20 may weld the conducting wire to connect to the PCB control board (not shown in the drawings) via the welding tab 23 on the side. This addresses the problem of short circuit caused by damaging the insulating member 30*a* due to small operation space during assembling, and improves yield rate and security of the electronic assembly.

Preferably, the electrode assembly further includes a connecting joint 50*a* embedded into the top cap 60; wherein the connecting joint 50*a* is provided with a through hole (not shown in the drawings) for accommodating the boss 32*a*, and the negative electrode 40 is sleeved onto a part of an outer side wall of the connecting joint 50*a* forming the through hole.

The connecting joint 50*a* is embedded into the top cap 60, the connecting joint 50*a* is provided with the through hole for accommodating the boss 32*a*, the negative electrode is sleeved onto a part of the side wall of the connecting joint 50*a* forming the through hole, such that the negative electrode 40 is in contact with the contact electrode of the atomizer via the connecting joint 50*a*. This improves conductivity between the electrodes, and enhances disassemblability of the electrode structure.

Specifically, the electrode assembly further includes an elastic member 70*a* arranged between the support 10*a* and the positive electrode 20.

The elastic member 70*a* may be arranged between the support 10*a* and the positive electrode 20 to allow the electronic cigarette to employ atomizers of various dimension specifications. As such, the structural height of the electrode assembly may be flexibly adjusted according to the dimension of the contact electrode of the atomizer, and therefore, adaptability of the electrode assembly is enhanced.

Preferably, the elastic member 70*a* is a spring.

To further improve applicability of the elastic member 70*a*, in this embodiment, the spring is preferably used as the elastic member 70*a*, which has simple structure and low cost.

Preferably, the spring is a conical spring, wherein a projection of the conical spring on a side of the positive electrode 20 towards the positive electrode 20 is greater than a projection thereof on the side of the positive electrode 20 towards the support 10*a*.

By virtue of the conical spring, the projection of the conical spring on the side of the positive electrode 20 towards the positive electrode 20 is greater than the projection thereof on the side of the positive electrode 20 towards the support 10*a*. This is favorable to increasing the operation stroke of the spring and enhancing adaptability between the electrode assembly and the contact electrode of the electronic cigarette.

Preferably, a spring fixing column 11*a* is arranged on a side of the support 10*a* facing towards the spring.

The spring fixing column 11*a* that is arranged on the side of the support 10*a* facing towards the spring may better fix the spring and improve operation reliability of the electrode assembly.

Preferably, a plurality of spring limiting points 24 are arranged on a side of the bottom plate 21 of the positive electrode 20 facing towards the spring, wherein the plurality of spring limiting points 24 collaboratively act to fix the spring.

The plurality of spring limiting points 24 that are arranged on the side of the bottom plate 21 of the positive electrode 20 facing towards the spring may cooperate with the spring fixing column 11*a* on the support 10*a*, such that the spring operates more reliably.

Preferably, a side wall of the through hole is provided with female threads (not shown in the drawings) for connecting a contact electrode of an atomizer.

The side wall of the through hole is provided with female threads for connecting the contact electrode of the atomizer of the electronic cigarette, which has better connection stability.

Preferably, the positive electrode 20, the negative electrode 40 and the connecting joint 50*a* are both made of copper.

In this embodiment, the positive electrode 20, the negative electrode 40 and the connecting joint 50*a* are all made of copper, which considers both conductivity and manufacture cost.

The present disclosure further provides an electronic cigarette. The electronic cigarette includes the above described electronic assembly. After the contact electrode of the atomizer is connected to the connecting joint 50*a* of the electrode assembly, the contact electrode is in contact with the conducting pillar 22 of the positive electrode 20, and the support 10*a* of the electrode assembly is connected to the battery cabinet of the electronic cigarette. The specific structure of the electrode assembly may be referenced to the above embodiment. Since the electronic cigarette employs all the technical solutions in the above embodiments, the electronic cigarette at least achieves the beneficial effects achieved by the technical solutions of the above embodiments, which are, however, not described herein any further.

The above are preferred embodiments of the present disclosure merely and are not intended to limit the patent scope of the present disclosure. Any equivalent structures made according to the description and the accompanying drawings of the present disclosure without departing from the idea of the present disclosure, or any equivalent structures applied in other relevant technical fields directly or indirectly are intended to be included in the patent protection scope of the present disclosure.

What is claimed is:

1. A power supply assembly comprising a cover body, and a main body inbuilt with a master control board, the cover body and the main body defining an installation space therebetween, wherein the power supply assembly further comprises a conductive contact structure that comprises a negative electrode assembly, a sealing element, an insulating assembly and a positive electrode assembly that are disposed in sequence in the installation space, the negative electrode assembly is configured for passing through the cover body to abut against the sealing element and defines a through hole configured for installing an external load, the insulating assembly has one end configured for covering the positive electrode assembly on the main body and has the other end abutting against the sealing element, the positive electrode assembly is configured for partially passing through the insulating assembly and the sealing element in sequence to be accommodated in the through hole, and the master control board is configured to be in electric connection with the positive electrode assembly and the negative electrode assembly;

wherein one of the insulating assembly and the sealing element is provided with at least one locating block while the other one defines locating grooves, and one of the locating block is inserted into one of the locating grooves so as to fix the sealing element to the insulating assembly.

2. The power supply assembly according to claim 1, wherein the sealing element comprises a big-diameter portion and at least one small-diameter portion located at a periphery of the big-diameter portion, the big-diameter portion is configured for blocking the through hole and defines a relief hole allowing the positive electrode assembly to pass through, and the small-diameter portion is opened/provided with the locating groove/locating block.

3. The conductive contact structure power supply assembly according to claim 2, wherein the relief hole is defined directing facing a center position of the through hole, and the relief hole has a diameter smaller than that of the through hole.

4. The power supply assembly according to claim 2, wherein the insulating assembly comprises a limiting plate and an insulating plate that fit a lateral edge structure of the positive electrode assembly, the limiting plate is configured to be installed on the main body and to enclose an accommodating groove, the insulating plate has one end configured for covering the accommodating groove and has the other end provided with at least one locating block, and the positive electrode assembly has one end elastically installed in the accommodating groove and abutting against the insulating plate and has the other end passing through the insulating plate and the relief hole to be accommodated in the through hole.

5. The power supply assembly according to claim 4, wherein the insulating assembly comprises an insulating ring, and the insulating ring is configured to be sleeved on the outer circumference of the positive electrode assembly located inside the through hole and to abut against an inner wall of the through hole.

6. The power supply assembly according to claim 1, wherein the negative electrode assembly comprises a connector and a conducting ring, the connector has one end embedded into an insulating plate and the other end accommodated in the installation space, the through hole is defined in the connector, the conducting ring is configured to be sleeved on the connector and abut against the sealing element, the connector is limited in the installation space, and the conducting ring is configured for electrically conducting the connector to the master control board.

7. The power supply assembly according to claim 1, wherein the positive electrode assembly comprises a conducting column and a conducting elastic sheet, the conducting column has one end passing through the insulating assembly and the sealing element to be accommodated in the through hole and has the other end fixedly connected to the conducting elastic sheet, and the conducting elastic sheet is configured to be fixedly installed on the master control board and to be electrically conducted to the conducting column.

8. An electronic cigarette, comprising an atomizer, and the power supply assembly, according to claim 1.

* * * * *